US005258073A

United States Patent [19]

Meier

[11] Patent Number: 5,258,073

[45] Date of Patent: Nov. 2, 1993

[54] METHOD FOR PREVENTING DEPOSITION ON PORTIONS OF WORKPIECES DURING CONTINUOUS SPRAY COATING

[75] Inventor: Christian Meier, Ruti, Switzerland

[73] Assignee: Precision Tool, Ltd., Switzerland

[21] Appl. No.: 589,512

[22] Filed: Sep. 28, 1990

[30] Foreign Application Priority Data

Sep. 28, 1989 [DE] Fed. Rep. of Germany ..... 3932312

[51] Int. Cl.[5] ..... B05B 15/04

[52] U.S. Cl. ..... 118/301; 118/317; 118/318; 118/322; 118/504; 427/421; 427/424; 427/425

[58] Field of Search ..... 427/421, 424, 425; 118/301, 324, 500, 503, 504, 317, 318, 322

[56] References Cited

U.S. PATENT DOCUMENTS 3,802,380 4/1974 Ford ..... 118/504 X
3,855,966 12/1974 Panas ..... 118/504 X
4,319,543 3/1982 Shank ..... 118/504 X
4,869,201 9/1989 Takahashi et al. ..... 427/424

*Primary Examiner*—Terry J. Owens
*Attorney, Agent, or Firm*—Antonelli, Terry, Stout & Kraus

[57] ABSTRACT

A system and method for preventing a deposition of a coating medium on at least a predetermined area of workpieces to be at least partially spray coated with the coating medium during a continuous spray coating operation. A covering arrangement is applied to the at least one predetermined area of the respective workpieces upon which the deposition of the coating medium is to be prevented prior to the continuous spray coating operation. The covering arrangement and the workpieces are simultaneously and synchronously advanced to the spray coating station so as to enable the continuous spray coating operation of the workpieces, with the predetermined areas covered by the covering arrangement being protected from deposition and/or contamination by the coating medium.

20 Claims, 4 Drawing Sheets

METHOD FOR PREVENTING DEPOSITION ON PORTIONS OF WORKPIECES DURING CONTINUOUS SPRAY COATING

FIELD OF INVENTION

The present invention relates to a system and method for spray coating workpieces and, more particularly, for preventing deposition of a coating medium on portions of the workpieces which are not to be coated during a continuous spray coating operation, with the portions of the workpieces not to be coated being separated from the portions of the workpieces to be coated by a covering during the spray coating process.

In, for example, DE-OS 25-58-846, a mask-like screening of a coating medium is proposed without actually covering the workpieces themselves.

When the workpieces are, for example, can bodies, in the powder coating of welded seams of the can bodies, the can bodies are moved over a coating arm which coating arm is provided with an output nozzle for dispensing a coating powder. It has been proposed to cover a seam area of the can bodies by, for example, stripping brushes or stripping strips mounted on a coating arm in such a fashion that, if possible, no coating powder is deposited on the can body outside of the seam area to be coated.

In the above-described arrangement, the can bodies are driven at a relatively high speed over the stripping strips and, a disadvantage of this proposal resides in the fact that, by virtue of the relative movement between the covering elements, namely, the stripping of brushes or stripping strips, and the surfaces to be covered on the workpieces, i.e., can bodies, such relative movement limits the control over the covering of the closure especially in view of workpiece tolerances and, the covering, in reality forms a dynamic seal.

SUMMARY OF THE INVENTION

The aim underlying the present invention essentially resides in providing a method and system for spray coating of work pieces such as, for example, can bodies, which avoids, by simple means, shortcomings and disadvantages encountered in the prior art and, in particular, avoiding the disadvantages associated with a dynamic type covering.

In accordance with the advantageous features of the present invention, for workpieces to be at least partially spray coated during a continuous operation, a method is proposed for preventing deposition of a coating medium on parts of the workpieces not to be coated, with the parts not to be coated to be separated from those to be coated during the coating process by means of a covering, with the method including applying the coverings before the coating process and during the continuous operation to the workpieces and, at least during the coating process, moving the coverings in a manner similar to the workpiece as the continuous process of the work pieces are continuously advanced.

By virtue of the above-noted features of the present invention, at least during the coating process, the coverings, with respect to the through flow feeding of the workpieces, are moved in the same manner as the workpieces and only a static of covering or seal is required between the covering and the workpiece. The attainment of a static covering or seal can more readily be accomplished in terms of its effect than the achievement of dynamic covering such as proposed in the prior art.

The method of the present invention when utilized for a powder or wet paint coating of welded seams, offers distinct advantages when there are parts to be coated and parts not be coated on the same surface of the work piece and, the method of the present invention is even more advantageous when the hollow bodies must be coated inside or outside and, in particular, when particular contamination by the coating medium of the non-outside or inside surface of the hollow body is an issue to be considered.

More particularly, with can bodies which are coated externally and constructed, for example, to accommodate foods, it of extreme critical importance that the inside surfaces are not contaminated by the coating medium which, as readily apparent, may later become loose or otherwise separated and fall into the accommodated food.

It is equally important for the internal coating of the workpieces such as, for example, can bodies, that an outside surface of the can body not be contaminated by the coating medium and, for example, if the outside surface is subsequentially printed or is already printed, any coating by a coating medium utilized for the internal coating of the workpiece adhering to the outside surface would adversely effect the printing already present on the outside surface of the container or possibly adversely effect subsequent printing operations.

In order to enable the hollow bodies to be coated at least partially internally or externally, especially with can bodies, in accordance with the present invention, the coverings are adapted to be applied externally or internally of the can bodies.

In welded seam coating of workpieces such as, for example, can bodies, various continuous coating methods have been proposed wherein the work pieces are moved during a coating process; however, coating methods have also been proposed in which the continuous coating operation takes place in cycles, with the coating being performed during rest cycles and, for example, the interior of the hollow bodies are sprayed or coated during pauses in the cycle.

In order to provide a static covering seal of the type contemplated by the present invention, for workpieces such as, for example, can bodies, moved during a coating in the feed direction or stopped in a coating phase, the coverings are moved either in the feeding direction or are stopped in the feed direction depending on the nature of the coating process being carried out thus, the coverings may either move in the direction of movement of the workpieces or, alternatively, the coverings may be stopped during a continuous operation with the workpieces.

Generally in all continuous methods, the workpieces are supplied and positioned in coating stations. In accordance with the present invention, the workpieces such as, for example, can bodies, can be positioned with coverings during the coating process and, consequently, may be simultaneously used to position the workpieces at least during the coating process or, in other words, the positioning elements required in any event may be replaced by coverings provided in accordance with the present invention.

In certain situations, for example, in an internal coating of hollow bodies, it may be necessary to move the workpieces relative to the spray-coating system and, for example, in a spray-coating of the interiors of the can bodies, it may be necessary to rotate the can bodies. For this purpose, in accordance with the present invention, the work pieces, during the coating process, may be moved cyclically relative to the spray coating arrangement by way of the coverings.

With substantially cylindrical workpieces such as, for example, can bodies, or cylindrical workpieces having a circumference which is to be coated, in accordance with further advantageous features of the present invention, the workpieces are adapted to be rotated about their longitudinal center axis during the coating process by the covering means.

In or for a spray-coating system for workpieces with a spraying station and a conveyor device, in order to enable a conveyance of the workpieces to, into and away from a spray station, in accordance with the present invention, the parts or portions of the workpieces not to be coated are prevented from being contaminated by a coating medium by virtue of the fact that the covering elements separate the portions of the workpieces to be coated from other portions not to be coated during the coating process.

In order to ensure that there is no relative movement between the workpieces and the covering elements in the spray station, at least during the coating process, and to enable the covering to act as a static seal, in accordance with the present invention, the covering elements are arranged so that movements thereof are coupled to movements of a conveyor device.

The desired movement coupling may be accomplished in a highly simplified manner in accordance with the present invention by fastening or mounting at least a portion of the covering of the elements to the conveyor device.

To enable an internal coating of the hollow bodies such as, for example, can bodies, is accordance with the present invention, a conveyor device is provided which includes a belt conveyor, upon which, at predetermined intervals, retaining shoes for coating hollow bodies internally are provided, with a feed device being provided in a side of the conveyor facing the retaining shoes. Covering shoes are supplied to the retaining shoes so that the retaining and covering shoes establish a receiving for the hollow bodies and cover the outside walls of the bodies during the coating of the interior of the respective hollow bodies. By virtue of the last mentioned features of the present invention, it is insured that the desired covering of the respective hollow bodies can be readily achieved by simultaneously insuring a solution to the positioning problem of the respective hollow bodies, which positioning problem would have to be addressed in any situation.

The retaining shoes mounted, fastened or forming a portion of a belt conveyor are moved toward the spray station with the work pieces inserted therein as the overall system operates, and, in accordance with the present invention, the covering shoes are supplied, for example, from above the retaining shoes already accommodating the workpieces so that the retaining and covering shoes jointly cover the exterior or outer surfaces of the workpiece and thus supply the inside coating station.

Advantageously, in accordance with further features of the present invention, the covering shoes are disposed on, for example, a belt conveyor which moves toward the belt conveyor accommodating the retaining shoes and is then moved in a direction away from the retaining shoes following the coating process of the hollow bodies.

If the interior of the respective hollow workpieces are to be coated in a coating station, the hollow bodies are necessarily open at both sides and are moved over a working arm provided with a coating nozzle, and the retaining and covering shoes are, in accordance with the present invention, constructed as receiving troughs aligned in a direction of movement of the conveyor.

For example, if the interiors of the hollow workpieces are coated at the coating station by a lance arrangement for supplying the coating medium, and, for this purpose, continuous operations operation is controlled cyclically, there will always be a number of workpieces simultaneously being internally coated by the coating lances. Thus, according to the present invention, the retaining and covering shoes may be provided with receiving troughs aligned transversely to the direction of motion of the conveyor.

For an external covering of the hollow bodies during an internal coating, whether the hollow bodies be open on both ends or closed at one end such as a semifinished can body, by virtue of the covering action of the covering elements, such covering elements may be contaminated with a coating medium. This problem may be solved in accordance with the present invention by continuously cycling the covering elements, that is, the retaining and receiving shoes forming the covering elements through a cleaning station at which the covering elements are cleaned so as to remove the contamination, with the cycling operation of the conveyor device as a belt conveyor.

While the above cycling is readily possible when using a coating powder, the decontamination cycling may result in relatively high expenses when the coating is in the form a sprayed wet paint or the like. In these circumstances, in order to reduce the expenses of cleaning or decontaminating, in accordance with present invention, lining inserts may be provided upon the retaining and/or receiving troughs, with the lining inserts being preferably interchangeable and preferable made of a plastic material.

By virtue of the last noted features of the present invention, the covering elements may then be either fashioned as disposable items and discarded after contamination or the covering elements may be readily removed and forwarded to a recycling operation, and/or the contaminated inserts may simply be replaced by new inserts and the contaminated inserts may be separately cleaned from the coating system.

If it is necessary or desirable during the coating process of an interior of the hollow body for the coating to be homogenized along the entire inside surface by rotating the hollow body along the longitudinal axis during a coating, in accordance with still further features of the present invention, a drive means may be provided on the retaining and/or covering shoes in order to set the respective workpieces into a rotational movement, with the drive means preferably being in a frictional contact with the respective workpieces.

It is also possible in accordance with the present invention to coat the hollow bodies both externally and internally simultaneously and, for this purpose, a conveyor device may be provided which includes a conveyor belt in which is arranged, at predetermined spaced intervals, radially spreadable retaining mandrels adapted to receive and cover an interior space of the hollow bodies to be coated externally.

Advantageously, the retaining mandrels are spreadable and provide a covering of the interior walls, with the retaining mandrels being constructed in a simple manner according to the present invention as, for example, an inflatable stocking or tubular member.

The retaining mandrels may, in accordance with the present invention, be coupleable with a drive means for rotating the respective workpieces during the coating process of the workpieces fashioned as hollow bodies.

While close-fitting or tight elements may be provided to cover the corresponding surface of the workpieces, it is also quite possible, in accordance with the present invention, to provide a labyrinth seal. In this connection, channels in the covering surfaces may be provided by, for example, roller brushing parts which insure a seal which are arranged so that small labyrinth-like gaps remain between the individual rolls or balls and the workpiece. This technical approach offers a simple possibility of ensuring a covering and rotating of the workpieces or a movement of the workpieces during the coating operation.

Advantageously, in accordance with still further features of the present invention, an air flow is generated between at least a portion of the covering elements and the workpieces to prevent the penetration of coating medium between the workpieces and the covering elements. For this purpose, the covering elements may be provided with gaps at the workpieces with the air circulation being forced through the gaps so that the covering action for the workpieces also provided.

According to the present invention, a method and system is provided of spray coating workpieces in a continuous operation with the prevention of a deposition of a coating medium on partially workpieces not to be coated, with the workpieces being positioned on a conveyor device and with, during a coating process, a cover separating the cover parts not to be coated from those to be coated being moved in synchronization with the conveyor device. The covering is applied to the workpieces prior to the coating process and during the continuous movement operation, with the work pieces being positioned on the conveyor device by the applied covering. In the spray coating system of the present invention, a conveyor device carries the workpieces past the spray station and the covering is moved in synchronization with the workpieces, which covering separates the parts of the workpiece to be coated from the parts not to be coated, with the covering being advantageously fashioned as form-fitting covering elements.

The above and other objects, features, and advantages of the present invention will become more apparent from the following description when taken in connection with the accompanying drawings which show, for the purposes illustration only, several embodiments in accordance with the present invention.

DETAILED DESCRIPTION

Figure 1:
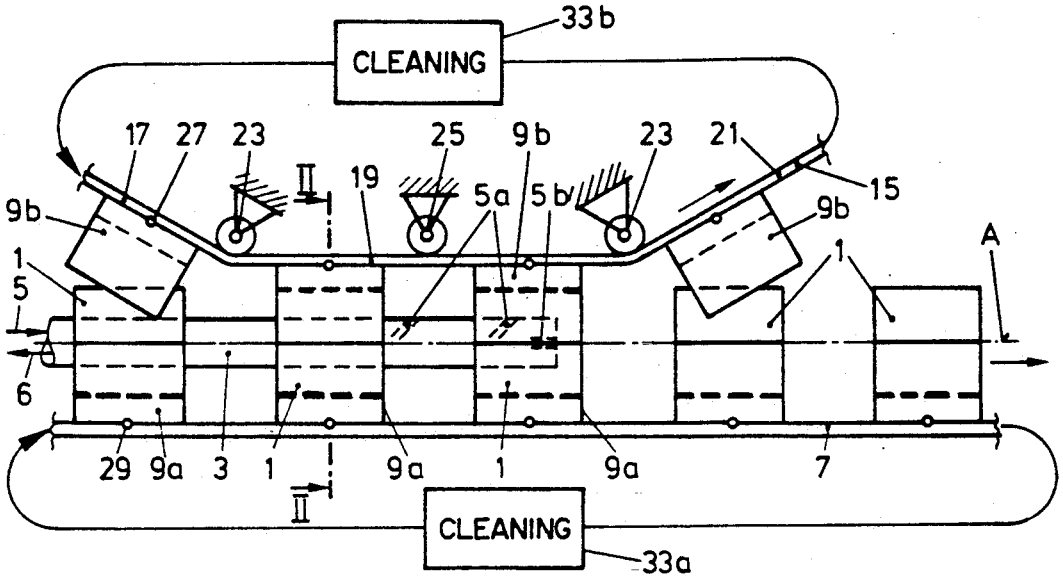
FIG. 1 is a schematic side view of a system for spray-coating workpieces constructed in accordance with the present invention.

Referring now to the drawings wherein like reference numerals are used throughout the various view to designate like parts and, more particularly, to FIG. 1, according to this figure, a spray-coating system in accordance with the present invention for carrying out a process of coating workpieces such as, tubular or hollow elements open at both ends such as, for example, can bodies on an interior wall of the respective can bodies with powder or wet paint either completely or preferably, only portions of the interior walls such as, for example, a welded seam of the can body, includes a working arm 3 for internal coating of can bodies 1, with the working arm 3 projecting away from a welding arm (not shown) for subsequently closing the open bodies in a conventional manner. The arm 3 includes at least one supply line for supplying a coating medium, with the coating medium being in the form of a coating powder or coating wet paint, and at least one suction return line 6 may be provided in the arm 3 for enabling a return of coating medium not applied. With an electrostatically enhanced coating, an electrical power supply (not shown) for a high voltage electrode system (not shown) may be provided and associated with the working arm 3 in a conventional manner. Depending on the wall area of the interior of the can bodies 1 to be coated, a nozzle arrangement is provided on the working arm 3, with the nozzle arrangement including, for example, a nozzle 5*a* for coating an elongated inside wall area such as, for example, a welded seam area of the can body 1, or a nozzle 5*b* for spraying the entire interior wall of the can body 1.

The workpieces, that is, the can bodies 1, are transported along the working arm 3 in a rapid sequence by a conveyor device including an endless belt 7 which may, for example, be of a plastic or metal material or may constructed as a chain link conveyor. To enable to transport of the can bodies 1, according to the present invention, retaining elements 9*a* are mounted at regular spaced intervals along the endless belt 7, with the retaining elements 9 serving primarily to move the can bodies 1 in a specific position along the working arm 3.

Figure 2:
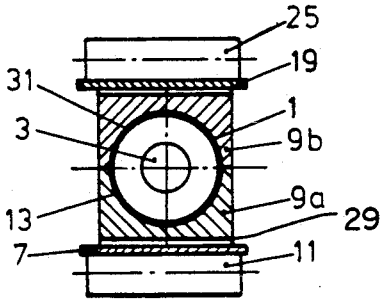
FIG. 2 is a cross-sectional view taken along line II—II in FIG. 1.

The conveyor belt 7 may be powered in a conventional fashion and, depending on the construction of the conveyor belt, may be driven by a drive rollers 11 and guided by guide rollers 25, with only one of the respective drive rollers 11 and guide rollers 25 being shown most fully in FIG. 2. The retaining elements in 9a, or also shown in FIG. 2, are substantially trough shaped and include a trough 13 extending parallel to a length of the endless belt 7. The can bodies 1 are transported in a lying position in the trough 13, with the trough 13 in the illustrated embodiment, being dimensioned so as to embrace and cover a half of a circumference of an outside wall of a can body 1 in an essentially positive manner.

As shown in FIG. 1, a second conveyor belt 15 is disposed in opposition to the conveyor belt 7 with respect to the working arm 3, with the second conveyor belt 15 extending from an area at the working arm 3 with the spray nozzle arrangement 5a and/or 5b toward the conveyor belt 7, in a first area 17 and then runs at least substantially parallel to the conveyor belt 7 in an area 19 and downstream from the nozzle arrangement 5a and/or 5b swings away again from the conveyor belt 7 into an area 21. The retaining elements 9a are mounted on the endless conveyor belt 7 so that relative turning movement of the retaining elements 9a can be executed without difficulty and, for this purpose, the retaining elements 9a may be mounted to the endless conveyor belt 7 by, for example, pivot or articulation means 29 which enables the respective retaining elements 9a to pivot within predetermined limits.

Deflecting rollers 23 and/or the guide rollers 25 guide the endless conveyor belt 15, with covering retaining elements or jaws 9b being fastened to second conveyor belt 15 by, for example, pivot or articulation means 27 so as to enable the covering elements 9b to be joined to the second conveyor belt in such a fashion to follow the partially curved path of the second endless conveyor belt 15 without difficulty.

The covering elements or jaws 9b are constructed substantially in the same manner as the covering element or retaining jaws 9a, namely, the retaining or covering jaws 9b have a trough-shaped depression 31 which substantially corresponds to one half of an exterior or outside area of the can bodies 1.

As shown most clearly in FIG. 1, the covering jaws 9b are moved in front of the nozzle arrangements 5a and/or 5b toward the can bodies 1 placed on the troughs 13 of the retaining jaws 9a and then, in the path area 19 of the conveyor belt 15, the covering jaws 9b fit closely against the outside walls of the can bodies 1 in such a manner that the can bodies 1 have the entire outer surfaces thereof covered by the retaining jaws 9a and the covering jaws 9b in an essentially positive manner.

Together with covering of the outside walls of the can bodies 1 in the manner described above, the can bodies 1 are moved along the nozzle arrangements 5a and/or 5b and powder or paint-coated in the required fashion along the interior walls of the respective can bodies 1. Immediately afterward or further downstream, depending upon particular requirements of the coating process, the second endless conveyor belt 15 is deflected or bends, as shown in FIG. 1, in the area 21, away from the belt 7 and the covering jaws 9b are lifted away from the can bodies 1. Preferably, the retaining jaws 9a and covering jaws 9b are, on the return runs of the endless conveyor belts 7 and 15, respectively moved through cleaning stations 33a and/or 33b, with the retaining jaws 9a and covering jaws 9b being then cleaned of the coating medium to which they were exposed due to the covering action of the jaws 9a, 9b during the coating process.

Figure 3:
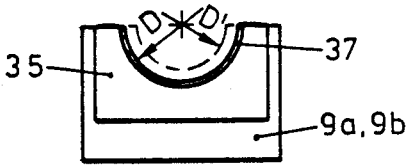
FIG. 3 is a schematic view of an alternate embodiment of a retaining and/or covering element or jaw for a spray-coating system constructed in accordance with the present invention.

If it develops that, despite the presence of the cleaning stations 33a and/or 33b, after a predetermined service life, the jaws 9a and/or 9b become permanently contaminated to an unacceptable level, in accordance with the present invention, as shown in FIG. 3, it is possible to cover the troughs and jaw parts most exposed to contamination with inserts 35 readily insertable or mountable on the respective jaws 9a and/or 9b, with the inserts being fashioned of an economical or inexpensive material so as to enable a disposal thereof upon acceptable contamination. For this purpose, the inserts 35 may be covered with, for example, an inexpensive plastic material which can withstand the prevailing temperatures to which the can bodies 1 are exposed as a result of the welding process to which the cans are subjected.

If, for some reason such as, for example, temperature-related reasons, relatively expensive insert material must be used for the inserts 35 such as, for example, TEFLON, the utilization of the inserts 35 is nevertheless beneficial since the contaminated inserts 35 can simply be removed and new inserts 35 replaced, with the contaminated inserts 35 then being centrally cleaned while a coating system continues operating substantially uninterruptedly. This latter approach enables an insert cleaning to be carried out with a continuous method but performed at a location other than a spray-system.

A further advantage of providing inserts 35 resides in the fact that an insert flexibility is achieved. More particularly, as shown in FIG. 3, a diameter D of the covering troughs at the jaws 9a and/or 9b can readily be changed by simply utilizing thicker or thinner inserts 35 whereby the jaws 9a and/or 9b are quickly converted to enable a working of workpieces having different external dimensions. Furthermore, the trough parts 37 of the inserts 35 may be made elastic so that the covering fit of the cooperating jaws 9a and/or 9b is increased.

Figure 4A:
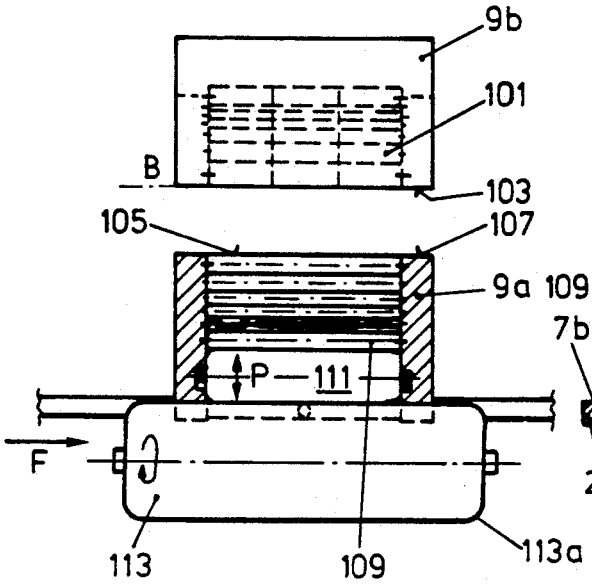
FIGS. 4*a* and 4*b* are partial cross-sectional side views of a rotating arrangement constructed in accordance with the present invention for rotating workpieces during a coating process.
Figure 4B:
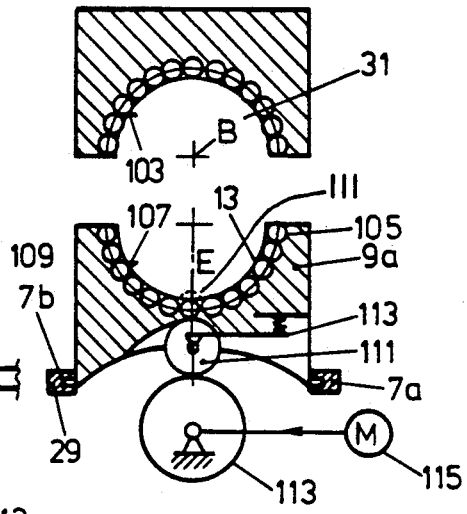

As shown in FIGS. 4a and 4b if the entire interior wall of the respective can bodies 1 is to be coated in accordance with the process outlined hereinabove, it may be advantageous during the coating process to rotate the can bodies along the longitudinal axis A (FIG. 1). To solve this problem, in accordance with the present invention, taking departure from the fact that not only does a positive covering result from the arrangement described hereinabove in connection with FIGS. 1-3 prevent coating from reaching the walls not to be coated, but conventional labyrinth or labyrinth-like seals may also be suitable for this purpose. Thus, it is not absolutely necessary to positively cover the entire wall to be covered or protected from coating but individual parts separated by narrow gaps, may have a covering action, with channels running between them in the manner of a labyrinth arrangement.

As shown in FIGS. 4a and 4b, in order to enable a rotation of the can body 1 around its axis during a coating process, a plurality of rollers 101 are mounted on the covering jaws 9b, with the rollers 101 being axially parallel to a trough axis B, and being freely rotatable. Both end parts of the covering jaws 9b may be formed by upwardly projecting collars 103 which project upwardly so that the rollers 101 project only a minimal amount above the collars 103. When a can body (not shown) is inserted in the jaw construction of FIGS. 4*a* and 4*b*, the can body lies primarily on the rollers 101 and a thin air gap is provided between an exterior wall and the collar 103. With a can body inserted into the covering jaw 9*b* in this manner, the can body is covered to prevent a contamination of the coating medium by the jaw 9*b*. The retaining jaws 9*a*, in turn, also have freely rotating axially directed rollers 105 extending along the troughs 13, and, as with the jaws 9*b*, are provided with collars 107 at the ends thereof.

As can readily appreciated, in lieu of freely rotating rollers 101 or 105, it is also possible to provide roller bearings in the form of ball members or the like, with the jaws 9*a* and 9*b* resting on one another to produce either a ball bushing or a roller bushing. With such an arrangement, a can body 1 inserted between the jaws 9*a* and 9*b* can be rotated with very little resistance about the longitudinal center axis A.

In order to achieve the above noted rotary motion or movement, the lowest roller 109 lying in a plane of symmetry E in trough 13 is in frictional engagement with a transmission roller 111 mounted in a rotationally movable manner on jaw 9*a*. The roller 109 is preferably mounted under a spring tension and is movable in a direction of the plane of symmetry E and may, within limits, as shown by phantom lines in FIG. 4*b*, be raised to a position 111' in the trough 13 against the force of a spring element at its bearings.

Similarly, preferably the transfer roller 111 is movable under spring tension not only at the jaw 9*a* rotationally, but also, as indicated by the spring bearing 113 and arrow P (FIG. 4*a*), in the direction of plane of symmetry E. In the embodiment of FIGS. 4*a*, 4*b*, the jaws 9*a* are mounted on belts 7*a*, 7*b* preferably located at respective sides of the jaws 9*a* with the jaws 9*a* being articulated by articulation means 29 in order to the jaws 9*a* to follow the path of the belt 7 illustrated in FIG. 1. The drive roller 113 is rotationally movably mounted and fixed in the spray system in a vicinity of the nozzle 5*b* and is driven, and as shown in FIG. 4*b*, by a suitable drive motor 115. The drive roller 113, as with the roller 111, may be provided with a frictional coating on the jaw 9*a* and is preferably permanently driven by the drive motor 115.

With the jaw 9*a* in the embodiment of FIGS. 4*a*, 4*b* having a can body inserted therein and with the jaw 9*b* closed over the can body, the can body 1 is advanced by the conveyor belts 7*a*, 7*b* and runs toward the coating area and transfer roller 111, during an axial feed motion thereof, and comes into frictional contact with the fixed drive roller 113 with such contact being facilitated by the beveled end faces 113*a* provided on the roller 113, especially in view of the spring mounting of the transfer roller 111, thereby ensuring a firm and sufficient frictional connection between drive roller 113 and the transfer roller 111.

When the transfer roller 111 is brought up against drive roller 113, the transfer roller 111 is easily accelerated against the force of the spring mounting against the trough, whereby the roller 111 is pressed against the roller 109, likewise provided with a spring mounting arrangement, and the roller 109, by virtue of the spring mount, is pressed by friction against the can body. The can body is then set into rotation in the freely running rollers 101, 105, while the can body is internally coated.

The close arrangement of the freely running rollers 101. 105 an arrangement of the collars 107, 103 ensure that no coating medium can strike the outside wall of the can body by virtue of the formation of a labyrinth type seal.

Figure 5:
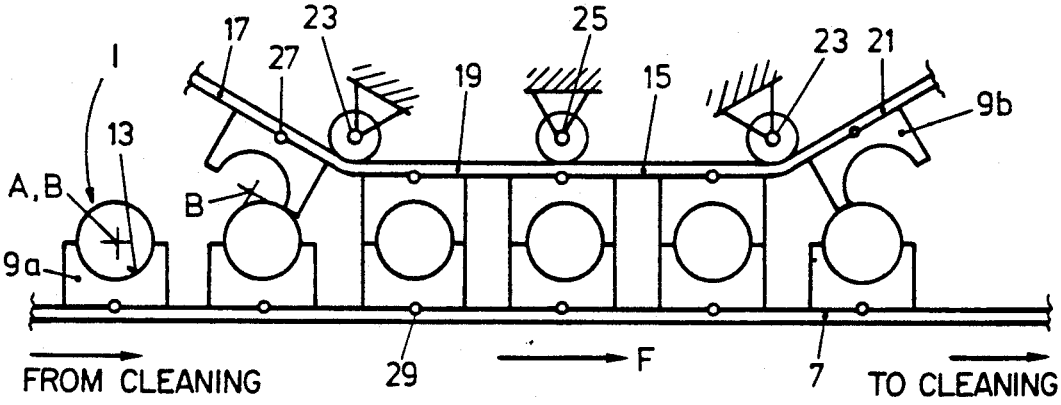
FIG. 5 is a schematic view of another embodiment of a spray-coating system constructed in accordance with the present invention.

The above described embodiments of FIGS. 1–4*a*, 4*b* propose a system and process whereby the coating is carried out in a continuous fashion over a working arm, with the coating being carried out for coating internal walls of the respective containers; however, FIG. 5 provides an example of another embodiment of a system, analogous to FIG. 1, which is suitable for hollow workpieces as well which are closed at one end and, consequently, is especially suitable for semi-finished cans with already shaped or mounted bottoms or lids.

In contradistinction to the embodiments described hereinabove in connection with FIGS. 1–4*a* 4*b*, in the embodiment of FIG. 5, the retaining jaws 9*a* are disposed on an endless conveyor belt 7 so that the longitudinal axes B of the troughs 13 run transversely to the feed direction of the belt 7. The workpieces or can bodies or semi-finished bodies which are to be internally completely or partially coated an are open at both ends or at only one end are then inserted with the longitudinal axes B of the bodies lying transversely or cross wise to a direction of travel of the endless conveyor belt 7 in the retaining jaws 9*a*. In the same manner, the covering jaws 9*b* are mounted on the second conveyor belt 15 in a manner described hereinabove so as to lie with the longitudinal axes B of the troughs being transverse to the direction travel F of the second endless conveyor belt 15.

By cooperation of the retaining jaws 9*a*, which then become the covering jaws, with the covering jaws 9*b* on the second endless conveyor belt 15, the belt being fed toward the endless conveyor belt 7 in the area 17 running parallel to the endless conveyor belt 7 in the area 19, and diverging again from the endless conveyor belt 7 in the area 21, the workpieces are positively covered at the outside walls in the area 19 in which the two endless conveyor belts 7 and 15 run parallel to each other. Consequently, a coating takes place in the area 19.

Figure 6:
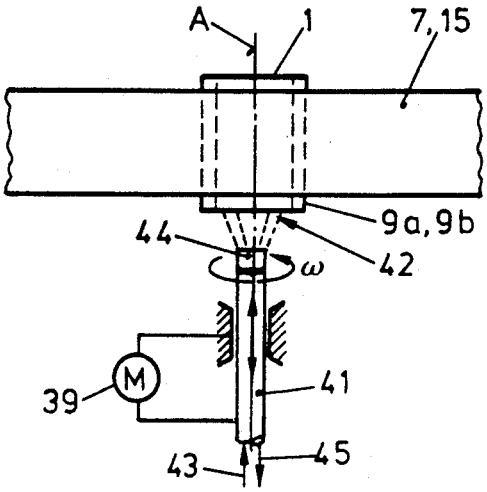
FIG. 6 is a schematic partial view of a spray station in the spray system of FIG. 5.

To enable a coating in the area 19, a so-called lance spraying is effected as shown most fully in FIG. 6. More particularly, in the area 19, where the outside walls of the workpieces are to be covered, a spray lance 41 is moved into a interior of the workpiece 1. During the inward movement and/or afterward in a stopped phase of the spray lance 41 and/or during a withdrawal of the spray lance 41 from the interior of the workpiece 1, a portion or, preferably, an entire interior of the workpiece 1 is sprayed with a coating powder or wet paint. The spray lance 41 is motorized and driven by a drive 39 in a conventional manner, with the spray lance 41 also being coaxially moveable with respect to the longitudinal axes A of the workpiece or the longitudinal axis of the troughs B at the jaws 9*a* and/or 9*b*.

It is also possible to, for example, position the spray lance 41 in a fixed position so that the spray opening is located immediately in front of or at the opening 42 of the workpiece 1. To enable the spray lance 41 to be moved axially in the direction of the double headed arrow in FIG. 6, a supply line 43 for the coating medium, corresponding to the supply line 5 of FIG. 1, and a suction line 45, corresponding to the return line 6 of FIG. 1, for suctioning the unused surface coating medium, are flexibly provided in the spray lance 41 in a conventional manner.

To perform a spraying process or operation, preferably the entire system is cyclically stopped with the endless conveyor belts 7 and 15 in the area 19 and one or more spray or coating lances 41 are then actuated or operated to spray the coating medium. In this cyclical operation, any number of workpieces can be simultaneously coated by providing a suitable number of coating or spraying or coating lances 41 operated in parallel with one another thereby, at least somewhat compensating for the loss of speed occasioned by the cyclic operation of the spraying or coating process. After several workpieces 1 have been simultaneously coated, the conveyor, that is, the endless conveyor belts 7 and 15, can be advanced very quickly for a distance corresponding to the subsequent number of workpieces to be coated without any need to consider the necessary coating times.

As readily apparent from the above description, the embodiment of FIG. 6 is advantageous in processing workpieces which are already sealed at one end, with the workpieces being internally coated with a coating medium. In this arrangement, the spray lances 41 are caused to be operated or displaced from an open side of the workpiece into the partially closed cavities of the workpieces 1.

It is also possible in accordance with the present invention for the jaws 9*a*, 9*b* of the embodiment of FIG. 5 to be constructed in accordance with the jaws 9*a*, 9*b* described hereinabove in connection with FIG. 4*a* and 4*b*, that is, with freely running rollers disposed in the troughs. Thus, even in the situation wherein the workpieces and jaws 9*a* and 9*b* are fixed in position during the coating process due to the cyclic operation of the arrangement of FIG. 5, a simple option is nevertheless provided of setting the workpieces into rotation during the spraying process. For this purpose, during the rest phase of the cyclic spraying operation, one or more of the rollers and/or roller arrangement of FIGS. 4*a* and 4*b* may be provided for effecting a drive engagement or, alternatively, if the workpieces are made of a magnetic material, it is also possible, for example, to provide a magnetic coupling for coupling for coupling the workpieces 1 to the sides of the jaws 9*a*, 9*b* at a position away from the spray lances 41.

It is also possible as shown in FIG. 6 for rotationally moving the nozzle area of the spray lances 41 and, in the simplest fashion, such can be accomplished by controlling a pressure of the delivered spray medium itself as is conventional with, for example, water in sprinkler systems. Or it is also possible for setting the spray area 44 of the lance so as to rotate in the direction of the circular arrow $\omega$ in FIG. 6.

It also possible in accordance with the present invention to utilize inserts 35, as described hereinabove in connection with FIG. 3 in the embodiments of FIGS. 5 and 6 for non-rotating workpieces. In this situation, the jaws 9*a* and 9*b*, during continuous operation, are forwarded to cleaning stations or cleaning devices or, after contamination, easily strippable and replaceable inserts may be provided.

Figure 7:
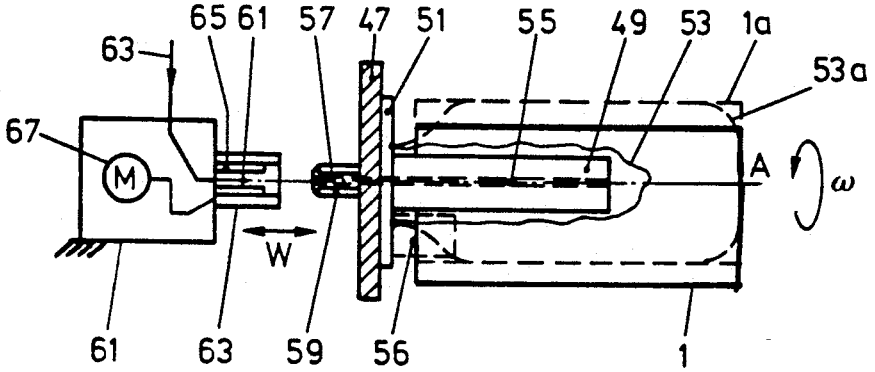
FIG. 7 is a partial cross-sectional schematical view of yet another embodiment of a spray system in accordance with the present invention in which an interior wall of a hollow body is to be coated or covered.
Figure 8:
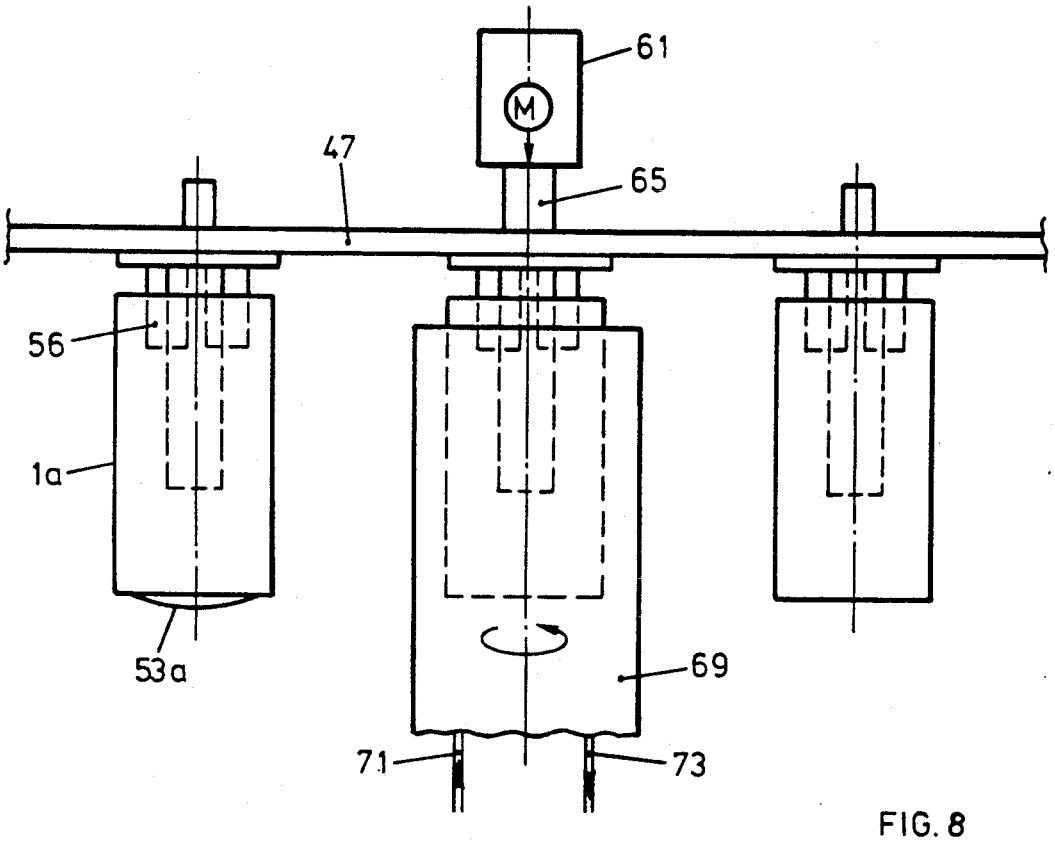
FIG. 8 is a schematic top view of the spray-system of FIG. 7.

The above system and procedure described hereinabove in connection with FIGS. 1–6 relates the covering of exterior walls of hollow workpieces to be coated internally; however, as shown in FIGS. 7 and 8, it is also possible in accordance with the present invention to coat an outside wall of similar bodies with the inside wall of the hollow bodies being covered. Although it is possible to utilize mechanically sprayed covering elements, the present invention provides a different technical approach, namely, the provision of a ball inflatable-like balloon in an interior of the hollow bodies which serves both to provide the necessary covering and also carry out the positioning functions by virtue of the equal pressure exerted by the balloon against the interior walls of the workpiece.

For this purpose, as shown in FIG. 7, vertically extending support mandrels 49 are mounted at regular intervals on a conveyor belt 47, with a mounting plate 51 being provided and facing the belt 47. The mounting plate 51 is rigidly connected preferably with the supporting mandrel 49 and with endless conveyor belt 47 provided workpieces 1 which may, for example, be can bodies open at both sides thereof which are either non-rotatable about the axis A or during an outer coating or are rotatable around axis A with respect to the belt 47 by, for example, the ball-bearing arrangement (not shown).

A rubber-elastic balloon or stocking 53 is anchored on the plate 51 in a sealing fashion, with the rubber-elastic stocking 53 extending over the mandrel 49. A pressure medium line 55 extends coaxially through the mandrel 49 and projects through the belt 47 and terminates at the back of the mandrel 49. A check valve (non shown) may be provided at the termination point 57 of the pressure medium line 55. If the workpiece 1 is to rotate about the axis A during the exterior or outside coating process, the termination point or outlet 57 is formed by a hollow axle stub having an interior bore communicating at one end with the pressure medium line 55 and, connected at the other end with the pressure medium line 55 and, connected at the other end with the mandrel 47 in a rigid fashion and, for example, is provided with external teeth 59 on which a drive means 61 with a drive axle 63 and internal teeth 65 can engage in order, through the connecting stub of the pressure medium line 55, to set the mandrel 49 rotating about the longitudinal axis A as indicated by $\omega$.

A drive station 61 is provided at least at one predetermined position opposite the mandrel 49 along the path of the endless conveyor belt 47. The drive station is connected with a pressure medium source (not shown) through a pressure supply line 63 and, if the mandrel 49 is to be rotated during the coating process, the drive station 61 is provided with a drive assembly 67.

A shown in FIG. 7, the workpieces 1 such as, for example, can bodies open at both ends, in an initially non-pressurized state of the balloon or stocking 53, are placed on the balloon or stocking 53 and the mandrel 49 and assume an eccentric position with respect to the longitudinal center axis A of the mandrel 49. In this position, the workpieces 1 are relatively loosely mounted and, if a relatively long path must be traversed from the mounting position illustrated in FIG. 7 to the coating station immediately after a positioning of the workpieces 1 and the uninflated stockings or balloons 53 over the mandrels 49, the stockings or balloons 53 are inflated. For this purpose, at the position illustrated in FIG. 7 spaced from the coating station, the stations 61 are permanently provided and are not connected with drive assembly 67 but only with a pressure medium supply line 63.

When the balloons or stockings are inflated, the balloons or stockings take inflated position or configuration as shown at 53*a*; however, if the position 53*a* does not provide the necessary positioning accuracy, internal positioning cams (not shown) may be provided and, if the workpieces 1 are to be rotated during coating, positioning rollers 56, acting as stops may be provided.

As shown by the double-headed arrow W in FIG. 7, by axial displacement of the connecting stub on the connecting unit 61, a sealing connection to the pressure medium line 55 is created and the balloon or stocking 53 is inflated, with the balloon or stocking 53 is inflated, with the balloon or stocking 53 assuming the position 53*a* as a result of the inflation thereby lifting the workpiece 1 into a position coaxial with respect to the longitudinal axis A of the mandrel 49, and possibly also determined by the positioning cams 56 so that the can assumes the position 1*a* in FIG. 7. The belt 47 is moved further and the connection of the line 55 disengages from the filling stub 65 of the units 61 with the check valve provided (not shown) at the inlet stub of the pressure medium line 55 preventing the pressure medium filling the balloon or stocking 53 or the pressure medium from the inflated stocking in the position 53*a* from escaping.

With the workpieces positioned at the position 1*a*, as shown in FIG. 8, the workpieces are further conveyed with the interior walls of the workpieces being neatly and substantially completely covered by the close fit of the pressurized balloons or stockings 53. One or more coating stations 69 for external spraying of the workpieces 1 with powder or wet paint are provided along the conveyance path of the endless conveyor 47 on a side thereof provided with the mandrels 49 and now centered workpieces 1*a*. The coating stations 69 are provided with coating medium supply lines 71 and suction lines 73 for suctioning excess coating medium. If the positioning cams or rollers 56 are provided, since the positioning cams or rollers 56 are disposed interiorly of the workpiece 1*a*, the presence of such cams or rollers 56 do not interfere with the coating process.

The coating stations 69 may include lance-shaped coating lances adapted to be slid over the exterior of the workpieces which are brought into the coating positions. The lances being slipped over the workpieces and including outlet openings for the coating medium to uniformly distribute the coating medium along interior surfaces of the coating devices 69 as shown most clearly in FIG. 9. With coating devices 69 constructed as lances, since such lances are capable of coating the entire exterior surface of the workpieces 1*a* by virtue of a regular distribution of the openings in the coating station 69 about the circumference of the workpieces, in most situations, a rotation of the workpieces around the longitudinal axes A during the coating process is not required.

However, if the coating stations 69 of FIG. 8 are constructed so that the workpieces 1*a* are coated from only one side thereof, for example, from below and along an entire length thereof, the workpieces 1*a* must be rotated around the longitudinal axis A to be certain that the entire exterior or outside surface of the workpieces 1*a* are regularly and uniformly coated. For this purpose, a drive arrangement or drive unit 61 is provided and aligned with the coating stations 69 relative to the endless conveyor belt 47 on a side opposite the respective coating stations 69. The drive arrangement or drive unit 61 includes an axle stub with internal teeth 65 which engage the connecting stub with external teeth 59 and, during the coating process, in other words synchronized with the coating process, sets the mandrel 49 and centered workpiece 1*a* into rotation.

When the coating process is complete, the endless conveyor belt 47 is moved further in the conveying direction and, at a drain station (not shown), by way of a check valve (not shown), the pressure is released from the balloon or stocking 53 so that the workpiece 1, now coated on an exterior surface thereof, is removable and can be further processed or transported as desired.

Figure 9:
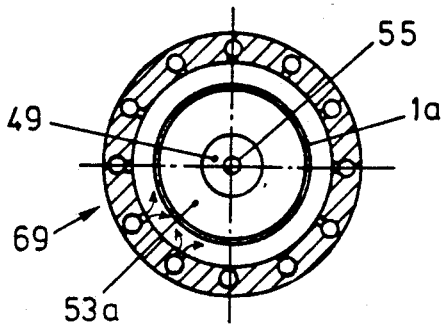
FIG. 9 is a schematic cross-sectional view of a spraying device for a spray-system of the present invention for enabling a simultaneous uniform coating of a exterior surface of a workpiece.
Figure 10:
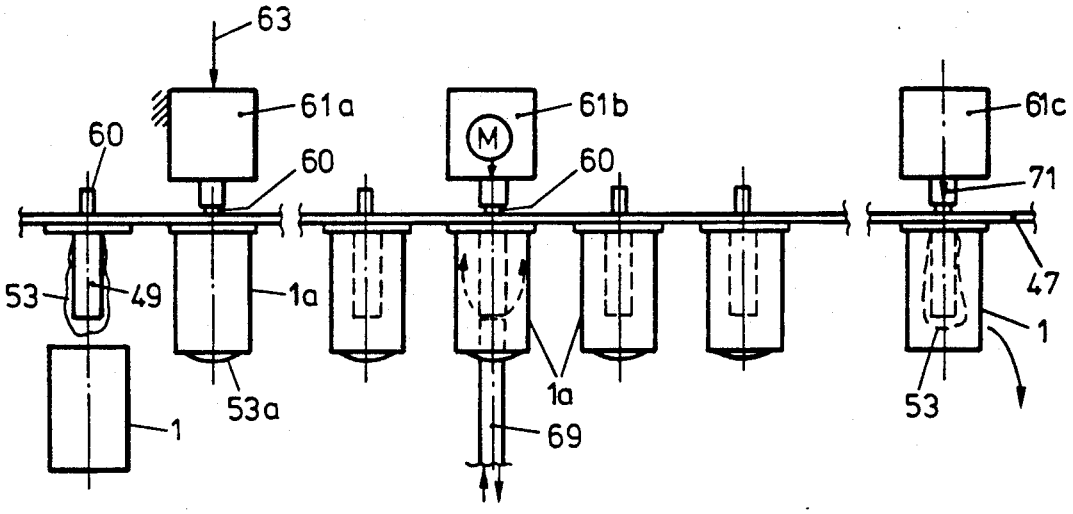
FIG. 10 is a schematic top view of a spray-coating system constructed in accordance with the present invention employing covering arrangements or members of FIGS. 7 and 8 for enabling an external coating of workpieces.

FIG. 10 provides a schematic representation of the process in accordance with the present invention utilizing a system such as described hereinabove in connection with FIGS. 7–9. More particularly, the workpieces 1 are externally coated with a coating arrangement which simultaneously sprays only a portion of the external wall of the workpiece so that the workpieces 1 must be rotated to achieve a uniform coating of the entire exterior surfaces thereof. At a first station, the workpieces 1 are loaded onto the mandrels 49 with the loose balloons or stockings 53 being accommodated in the interior of the workpieces 1. At a station immediately following the first station, a fixed station 61*a* inflates the balloons or stockings 53 by connections to the stubs 60. The workpieces 1 are then centered so that the workpieces assume the position 1*a*. The workpieces 1*a* are then further carried in the centered position with the pressure in the balloons or stockings 53 being maintained by way of the check valve.

When the coating station is reached, the stubs 60 are mechanically coupled to the unit 61*b* and set into rotation by a motor M while simultaneously being coated at the exterior surface thereof by the coating device 69. Then the workpieces 1*a*, now externally coated and still centered, are further conveyed until they reach the station 61*c* where, an intervening means 71 opens the check valve so as to result in a deflation of the balloon or stocking 53 thereby enabling an unloading of the workpieces 1.

Since the above described process and system illustrated in FIG. 10 must be cyclically performed, the simultaneous processing of several workpieces 1 can be carried out during the respective cycles and, for example, five or ten workpieces may be processed in a given cycle so there is always one group of workpieces 1 to be processed being loaded, positioned, advanced, coated, etc.

As noted hereinabove, instead of a positive covering at the corresponding workpiece surfaces not to be coated, it is also possible to seal such surfaces against the coating medium using labyrinth seals which, at least in certain segments, provide air gaps relative to the workpiece areas to be covered.

Moreover, it is also possible in accordance with the present invention to increase the sealing action against the coating medium by generating an air circulation using, for example, compressed air in the gaps such as the gaps in the labyrinth seals, with the air acting in a direction against the direction of spraying of the coating medium that might try to penetrate such gaps thereby keeping the coating medium away by a blowing action out of the gaps between the covering elements of the present invention placed around the workpieces as well as the gaps between the workpieces themselves.

While I have shown and described only one embodiment in accordance with the present invention, it is understood that the same is not limited thereto but is susceptible to numerous changes and modifications as known to one of ordinary skill in the art, and I therefore do not wish to be limited to the details shown and described herein, but intend to cover all such modifications as are encompassed by the scope of the appended claims.

I claim:

1. System for preventing a contamination by a coating medium of at least one area around an external surface of workpieces in the form of hollow bodies to be interiorly at least partially spray coated by the coating medium during a continuous spray coating operation at a spray coating arrangement for workpieces, including a spray coating station; a first conveyor means having a first endless conveyor belt; first shoe means coupled to said first endless conveyor belt at spaced intervals for enabling an insertion and a retention of said hollow bodies on said first endless conveyor belt; a second conveyor means having a second endless conveyor belt; wherein said first endless conveyor belt and said second endless conveyor belt are run in parallel and synchronized to said spray coating station in a facing relationship; and wherein said second endless conveyor belt of said second conveyor means comprises second shoe means at said spaced intervals therealong and wherein said first endless conveyor belt and said second endless conveyor belt are disposed in said spray coating station so that said first shoe means and said second shoe means form a covering collar for a respective hollow body therein, covering at least a part of an external surface of said respective hollow body and around said body to prevent said part of the external surface from being contaminated by said interiorly applied coating medium.

2. System according to claim 1, wherein the system further includes covering means for separating at least one area of said workpieces not to be contaminated from another area of said workpieces to be coated coupled to the first conveyor means prior to the spray coating station and remain coupled to the first conveyor means at least through the spray coating station.

3. System according to claim 1, wherein said system further includes feed means for feeding the second shoe means relative to the first shoe means, said feeding means being positioned on a side of said first endless conveyor belt facing the second shoe means, and wherein the respective second shoe means and the respective first shoe means are adapted to be positioned relative to each other to define a receiving area accommodating the respective hollow bodies and covering the outside wall surfaces of the respective hollow bodies at least during a spray coating of interiors of the hollow bodies by the spray coating station.

4. System according to claim 3, wherein said second endless conveyor belt is arranged so as to move first in a direction toward said first endless conveyor belt, through the spray coating station substantially parallel to said first endless conveyor belt, and then in a direction away from said first endless conveyor belt.

5. System according to one of claims 3 or 4, wherein each of said first shoe means and said second shoe means comprise receiving troughs for receiving the hollow bodies, said receiving troughs being aligned in a direction of movement of said first endless conveyor belt.

6. System according to one of claims 3 or 4, further comprising lining insert means arranged in each of the first shoe means.

7. System according to claim 6, wherein said lining insert means are interchangeable.

8. System according to claim 7, wherein said insert means are made of a plastic material.

9. System according to one of claims 3 or 4, further comprising a drive means provided on the respective first shoe means for rotatably driving the respective hollow bodies.

10. System according to claim 9, wherein said drive means includes means adapted to be brought into frictional contact with the respective hollow bodies.

11. System according to one of claims 3 or 4, wherein each of said first shoe means and said second shoe means comprises receiving troughs for receiving the hollow bodies, said receiving troughs being arranged transversely to a direction of movement of said first endless conveyor belt.

12. System according to claim 11, further comprising lining insert means disposed in said receiving troughs.

13. System according to claim 12, wherein said insert means are interchangeable.

14. System according to claim 13, wherein said insert means are made of a plastic.

15. System according to one of claims 1 or 2, wherein said system includes covering means associated with the respective workpieces for separating at least one area of the respective workpieces not to be contaminated by the coating medium from said area of the workpieces to be coated during the continuous spray coating operation at the spray coating station, and wherein said covering means includes a plurality of radially spreadable retaining mandrel means arranged at spaced intervals along said endless conveyor belt for receiving and covering an interior space of the respective hollow bodies which are to be coated externally at the spray coating station.

16. System according to claim 15, wherein said retaining mandrel means are pneumatically spreadable.

17. System according to claim 16, wherein said retaining mandrel means includes a pneumatically inflatable element adapted to conform to the interior space of the respective hollow bodies.

18. System according to claim 15, further comprising drive means coupleable with the respective retaining mandrel means for rotating the respective hollow bodies at the spray coating station.

19. System according to one of claims 1 or 2, wherein said covering means define labyrinth seal means with respect to the respective workpieces.

20. System according to one of claims 1 or 2, further comprising means for generating an air flow between at least a portion of the covering means and the respective workpieces to prevent a penetration of coating medium between the respective workpieces and associated covering means.

* * * * *